US005113564A

United States Patent [19]

Suzuki

[11] Patent Number: 5,113,564

[45] Date of Patent: May 19, 1992

[54] DEVICE FOR UNDOING YARN FROM TUBULAR KNITTED FABRIC

[75] Inventor: Seiichi Suzuki, Ohta, Japan

[73] Assignee: Daisuzu Kogyo Co., Ltd., Gunma, Japan

[21] Appl. No.: 738,035

[22] Filed: Jul. 31, 1991

[30] Foreign Application Priority Data

Jul. 31, 1990 [JP] Japan ..... 2-203499

[51] Int. Cl.[5] ..... D02G 1/00

[52] U.S. Cl. ..... 28/218; 28/217; 242/35.5 R

[58] Field of Search ..... 28/218, 219, 217; 242/35.5 R

[56] References Cited

U.S. PATENT DOCUMENTS

| | | | |
|---|---|---|---|
| 3,861,176 | 1/1975 | McWhirter et al. | 28/218 X |
| 3,919,749 | 11/1975 | McWhirter et al. | 28/218 |
| 4,327,464 | 5/1982 | Hutcheson | 28/218 |
| 4,913,252 | 3/1990 | Shepherd et al. | 28/218 X |

*Primary Examiner*—Werner H. Schroeder
*Assistant Examiner*—Bibhu Mohanty
*Attorney, Agent, or Firm*—Fred Philpitt

[57] ABSTRACT

The yarn undoing device comprises a rotary trunk for mounting the knitted fabric, a plurality of yarn winding rotary members disposed at a proper distance at an outer extended position upward of the rotary trunk, a drive device for rotating the rotary trunk in a direction opposite a direction where the yarn of the knitted fabric is undone and rotating it intermittently for a fixed amount of rotation set on the basis of a shifting range of the undoing of the yarn, a clutch provided on the yarn winding rotary members, a device for setting a shifting range of the undoing of the yarn to be drawn from the knitted fabric provided on the rotary trunk to a range where the yarn is rewound on the yarn winding rotary member without causing the twisting and the like and detecting an amount of a range where the yarn to be drawn from knitted fabric provided on the rotary trunk is undone, and a device for performing the engaging or disengaging operation of the clutch of the yarn winding rotary member and driving operation of the drive device of the rotary trunk on the basis of the undone amount of the yarn detected by the detecting device.

1 Claim, 3 Drawing Sheets

DEVICE FOR UNDOING YARN FROM TUBULAR KNITTED FABRIC

BACKGROUND OF THE INVENTION

This invention is to undo a tubular knitted fabric which is knitted in tubular form by a circular knitting machine, and more particularly to a device for undoing or unknitting yarn from a tubular knitted fabric by rewinding a yarn to be unknitted from the knitted goods on a bobbin without causing the twisting and the like.

Heretofore, the knitted goods are such which are knitted by means of a flat knitting type machine or which are knitted by a circular knitting type machine. These knitted goods generally use expensive yarns and should an error occur in the knitting, the yarn is unknitted and is rewound on a bobbin to be reused.

As a device for rewinding the yarn on the bobbin while undoing the foregoing knitted goods, Japanese Patent Application No. 1-303262 was filed in Japan by an applicant identical with the present applicant of this application. Namely, the device of this application, as shown in FIG. 6, a yarn guide shaft 102 and a detecting bar 103 for detecting a hooking of the yarn are installed at positions that become a series for each of a plurality of yarn winding rotary members 101, and a guide lateral lever 104 is installed at a predetermined interval from the detecting bar 103, and a plurality of yarns 106 undone from a knitted fabric 105 are wound on a bobbin 108 provided on each yarn winding rotary member 101 through a yarn guide 107 of each detecting bar 103 from the above of the guide lateral lever 104, and in the condition where the detecting bar 103 is descended from the foregoing position by its own dead weight, the yarn 106 is introduced and guided in an inverted triangle form between the yarn guide 109 of the guide shaft 102 and the guide lateral lever 104, and when the hooking occurs at a stitch of the knitted fabric 105 which results in the condition where the yarn is not undone, the detecting bar 103 is lifted between the guide shaft 102 and the guide lateral lever 104 by the tension of the yarn and the drive device for the yarn winding rotary member 101 is initiated by the elevation of the detecting bar 103, and the vibration is applied to the stitch of the knitted fabric 105 to unknit the hooking of the stitch.

However, the foregoing device for undoing yarn from the knitted goods described in the foregoing was suitable for undoing the knitted fabric knitted by a flat knitting machine, but it was not suitable for undoing the tubular knitted fabric produced by the circular knitting machine. Namely, the flat knitting machine reciprocated the yarn guide to knit so that the knitted fabric was finished in a flat form and, in order to undo it, the yarn was undone while it was reciprocating the stitch of the knitted fabric. But, the hooking tended to occur at both end portions of the knitted fabric so that when the hooking occurred, the detecting bar lifted to stop the rotation of the yarn winding rotary member temporarily to eliminate the hooking of the yarn by giving the vibration to the stitch. However, the circular knitting machine was to knit while the yarn guide was rotating so that the knitted goods was knitted in tubular form and in order to undo it, the unknitting stitch of the yarn was taken place like rounding around the knitted fabric, and for this reason, in the conventional yarn unknitting device for the tubular knitted fabric, the twisting of the yarn and the like occurred at the time of the unknitting which was the problem

SUMMARY OF THE INVENTION

An object of this invention is to provide a device for undoing yarn of tubular knitted fabric which is capable of rewinding the yarn on a bobbin without causing the twisting of the yarn to be undone and the like when the tubular knitted fabric which is knitted in tubular form is undone.

Another object of this invention is to arrange a yarn winding rotary member at an extended position of information of the rotary trunk for mounting the knitted fabric and the rotary trunk is made to move intermittently in a direction opposite a direction of undoing the yarn for each fixed rotating amount to be determined on the basis of a range in which the undoing stitch of the yarn shifts, and the yarn is rewound on the yarn winding rotary member without causing the twisting of the yarn and the like to be undone from the knitted goods.

DETAILED DESCRIPTION OF THE INVENTION

Figure 1:
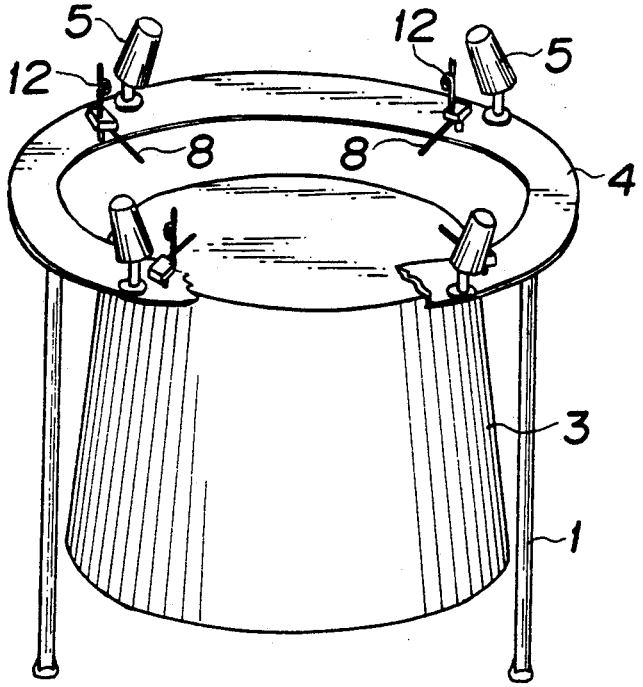
FIG. 1 is a perspective view shown by partly notching a circular seat.
Figure 3:
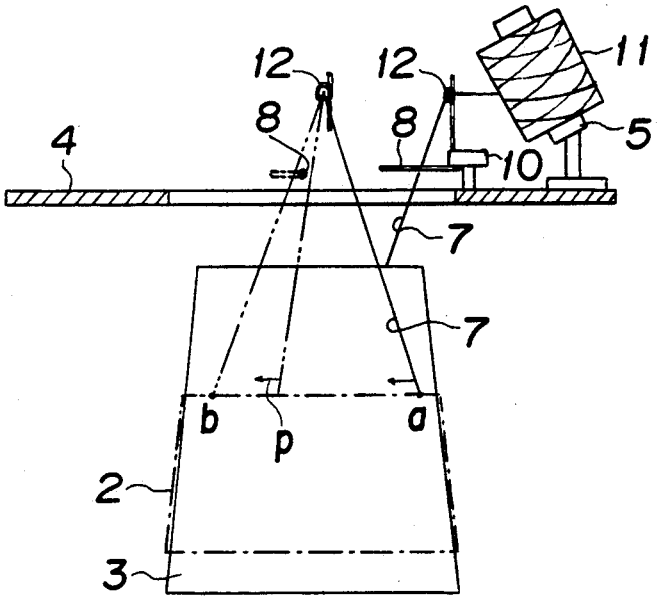
FIG. 3 is an elevation showing the condition where the undoing stitch of the yarn is positioned at a start point.
Figure 4:
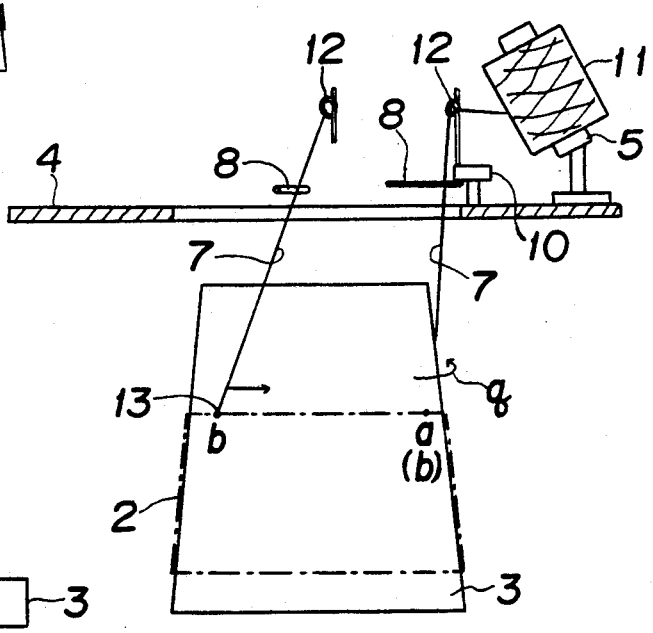
FIG. 4 is an elevation showing the condition where the undoing stitch of the yarn is positioned at an end point.
Figure 5:
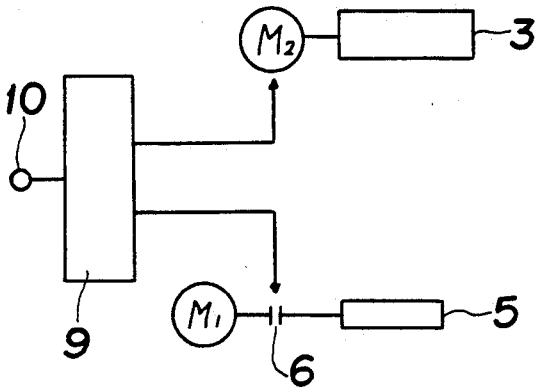
FIG. 5 is a block diagram.
Figure 6:
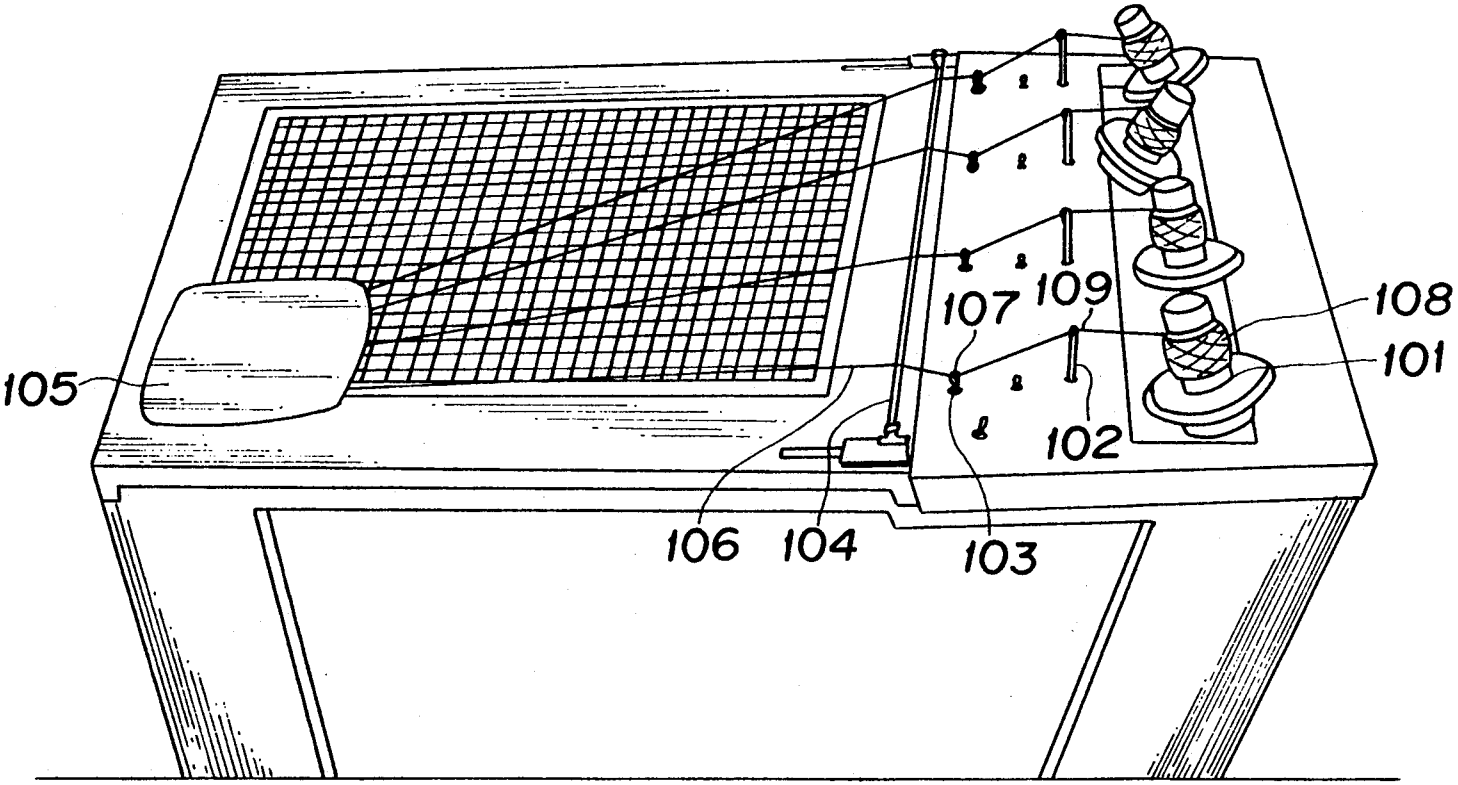
FIG. 6 is a perspective view showing the conventional device for unknitting flat knitted fabric.

An embodiment of this invention will be described by referring to appended drawings, FIG. 1 to FIG. 5 show a device for undoing yarn of knitted goods according to this invention, and in FIG. 1, a rotary trunk 3 for mounting the tubular knitted fabric 2 is provided in a machine frame 1, and a circular seat 4 is provided at a position surrounding an external extension of upward of the rotary trunk 3 on the upper portion of the machine frame 1, and a plurality of yarn winding rotary members 5 are disposed at a fixed proper interval on the circular seat 4, and these yarn winding members 5, as shown in FIG. 5, are connected to a motor $M_1$ rotating continuously at a proper speed which has a clutch 6 respectively. The rotary trunk 3 is arranged to rotate intermittently for a fixed amount in a direction opposite a direction of unknitting the yarn shown by an arrow p in FIG. 3 by means of an intermittent motor $M_2$, namely, a direction of arrow mark q, and a lever 8 for detecting an amount of range where the yarn 7 to be undone from the knitted fabric 2 placed on the rotary trunk 3 is provided on the yarn winding rotary member 5. An intermittent amount of rotation of the motor $M_2$ is set to an amount equal to a shifting range from a point a to a point b of the undoing stitch 13 of the yarn 7 in the range where the yarn 7 to be undone from the knitted fabric 2 mounted on the rotary trunk 3 without the twisting and the like is rewound on the yarn winding rotary member 5. The setting is made in such a way that the lever 8 causes the clutch 6 to be engaged when the yarn 7 reaches the point a, and the clutch 6 is disengaged when the yarn 7 reaches the point b. A program controller is provided as the device for for performing the engagement or disengagement of the clutch 6 of the yarn winding rotary member 5 by the detecting lever 8 and the driving operation of the motor $M_2$ of the rotary trunk S on the basis of the undone amount of the yarn 7 detected by the detecting lever 8. The lever 8 is connected to a detecting switch 10 of the program controller 9, and the engaging or disengaging operation of the clutch 6 and the intermittent driving operation of the motor $M_2$ of the rotary trunk S are carried out by the operation signal of the program controller inputted on the basis of the switching operation of the detecting switch 10.

Figure 2:
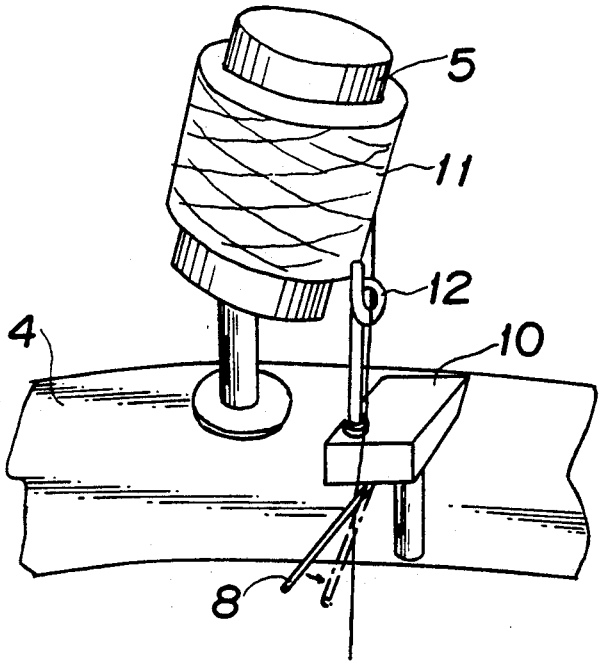
FIG. 2 is a perspective view which is an enlarged view of an essential portion showing the installed condition of a yarn winding rotary member and a detecting switch.

As shown in FIG. 2 where the essential portion is enlarged, a yarn guide 12 for guiding the yarn 7 drawn from the knitted fabric 2 provided on the rotary trunk to be a bobbin 11 placed on the yarn winding rotary member 5 is provided on an inside edge portion of the circular seat 4, and a detecting switch 10 is installed at the inside edge of the circular seat 4 positioned between the knitted fabric 2 to be provided on the rotary trunk 3 and the yarn guide 12, and the lever 8 for closing the detecting switch 10 is installed to be projecting into the path of the yarn 7. The undoing stitch 13 of the yarn 7, as shown in FIG. 3, moves in such a way that the undoing stitch 13 of the knitted fabric 2 shifts from the point a while the yarn 7 is rewound on the yarn winding rotary member S, and in the course of the yarn 7 that expands the angle aslantly with the yarn guide 11 as a fulcrum, it engages the lever 8, and the undoing stitch 13 of the yarn 7 further advances and when it reaches the point b that is the limit of the operation range where the yarn 7 is undone, the lever 8 operates to close the detecting switch 10.

FIG. 5 is a block diagram of the operation of this invention, and the program controller 9 makes the clutch 6 in cut off condition when the detecting switch 10 is closed, and at the same time, the motor $M_2$ of the rotary trunk 3 is operated, and after a lapse of a fixed time from the rotation of the rotary trunk 3 for a fixed amount, the driving of the motor $M_2$ is suspended, and the switching operation signal of the clutch 6 and the driving operation signal of the motor $M_2$ are applied on the basis of the switching of the detecting switch 10.

As shown in FIG. 3 and FIG. 4, the intermittent amount of rotation of the rotary trunk 3 is set at an amount equal to an amount of shift from the start point a to the end point b of the undoing stitch 13 of the yarn 7. When the lever 8 moves in such a way that the clutch 6 is disengaged when the undoing stitch 13 reaches the end point b, and the yarn winding rotary member 5 is suspended once, and in the meantime, the rotary trunk 3 turns in a direction opposite the undoing direction of the yarn 7, and the undoing stitch 13 returns to the start point a from the end point b, and the rewinding operation of the yarn 7 is carried out in a fixed range with the yarn guide 12 as a fulcrum, namely, between the start point a and the end point b so that the yarn undone from the tubular knitted fabric 2 from the above so that the fabric 2 can be fixed by being stabilized to the outer periphery of the rotary trunk S so that it is preferable to be formed in a truncated cone.

Also, in this embodiment, the program controller 9 is used as the device for giving the engaging or disengaging operation of the clutch 6 and the driving operation of the rotary trunk 3, but separately from this arrangement, for example, the operation may be carried out by the control device such as relay, sequence control device and the like.

Accordingly, the rewinding operation of the yarn is carried out in a range from the start point of the undoing stitch to be determined by the rotation of a fixed amount of the rotary trunk and the end point of the undoing stitch to be determined by the lever so that the yarn undone from the tubular knitted fabric is rewound on the bobbin automatically without causing the twisting and the like. Namely, the tubular knitted fabric is mounted on the rotary trunk and when the rotary trunk is suspended, the yarn winding rotary member rotates, and the undoing stitch of the yarn to be undone from the tubular knitted fabric reaches the predetermined position, namely, it reaches the condition where just before twisting and the like occurs to the yarn, the rotation of the yarn winding rotary member is once suspended, and the rotary trunk is rotated to a predetermined range in a direction opposite the undoing direction of the yarn and is suspended, and while the rotary trunk is suspended, the yarn winding rotary member is rotated again to take up the yarn, and when the operation conducted with the yarn winding rotary member and the rotary trunk is repeated, whereby the undoing stitch of the yarn to be undone from the knitted fabric is unknitted in a fixed range always centering about the yarn winding rotary member, and therefore, the rewinding on the yarn winding rotary member can be made without causing the twisting and the like on the yarn to be undone.

I claim:

1. A device for undoing yarn of tubular knitted fabric comprising a rotary trunk for mounting the tubular knitted fabric, a plurality of yarn winding rotary members disposed at a proper distance at an outer extended position upward of the rotary trunk, a drive device for rotating the rotary trunk in a direction opposite to a direction of which the yarn of the tubular knitted fabric mounted on the rotary trunk is undone a device for driving the yarn winding rotary members, a clutch provided on the yarn winding rotary members a device for detecting an amount of length of the yarn to be drawn from the tubular knitted fabric provided on the rotary trunk, and a device for performing the engaging and disengaging operation of the clutch of the yarn winding rotary members and means for intermittent driving operation of the drive device of the rotary trunk on the basis of the amount of the length of the yarn detected by the detecting device.

* * * * *